US006073931A

United States Patent [19]

Voden

[11] Patent Number: 6,073,931

[45] Date of Patent: Jun. 13, 2000

[54] FOLDING BACKBOARD FOR RECEIVING A DART BOARD THEREON

[75] Inventor: Justin L. Voden, Waukesha, Wis.

[73] Assignee: Great Lakes Dart Mfg., Inc., Muskego, Wis.

[21] Appl. No.: 09/018,489

[22] Filed: Feb. 4, 1998

[51] Int. Cl.[7] ..... F41J 3/00

[52] U.S. Cl. ..... 273/404; 273/407; 273/408

[58] Field of Search ..... 273/403, 404, 273/407, 408, 409, 410

[56] References Cited

U.S. PATENT DOCUMENTS

| | | | |
|---|---|---|---|
| D. 328,726 | 8/1992 | Beall et al. | D21/5 |
| D. 387,388 | 12/1997 | Beall | D21/6 |
| 3,139,281 | 6/1964 | Nicholson | 273/285 X |
| 3,501,149 | 3/1970 | Meyer | 273/407 |
| 3,979,117 | 9/1976 | Worsham | 273/408 |
| 4,151,996 | 5/1979 | Lee et al. | 273/407 |
| 4,625,974 | 12/1986 | Andrews | 273/407 |
| 4,872,679 | 10/1989 | Bohaski et al. | 273/317.5 |
| 5,540,443 | 7/1996 | Ballan et al. | 273/285 |
| 5,553,850 | 9/1996 | Savu et al. | 273/408 X |

*Primary Examiner*—William H. Grieb
*Attorney, Agent, or Firm*—Whyte Hirschboeck Dudek S.C.; Timothy J. Ziolkowski

[57] ABSTRACT

The present invention provides a folding backboard for receiving a dart board thereon. The folding backboard protects a wall, or some other fixed surface, by being able to receive and secure poorly thrown darts without damage to the dart tips. The folding backboard comprises a first section which is foldably attached to a second section. The backboard unfolds into an open position in which the dart board is readily mounted to each section of the folding backboard, and folds into a closed position to minimize the width or height of the backboard for storing or transporting the backboard when the dart board is removed. The present invention also includes a dart center which incorporates the aforementioned folding backboard and further includes a dart board and throw-line marker. The dart center may also incorporate various dart accessories, including darts, a chalkboard, chalk, an eraser and a rack for storing darts, and may further include assorted hardware for mounting the folding backboard to a wall, or other fixed surface, in addition to hardware for mounting the dart board to the folding backboard. In one embodiment, the folding hinge is offset from the center of the backboard so that a logo or advertisement can be visually displayed when the backboard is folded. This configuration is particularly advantagous in promoting the logo or advertisement when the dart center is placed for sale in retail outlets.

22 Claims, 3 Drawing Sheets

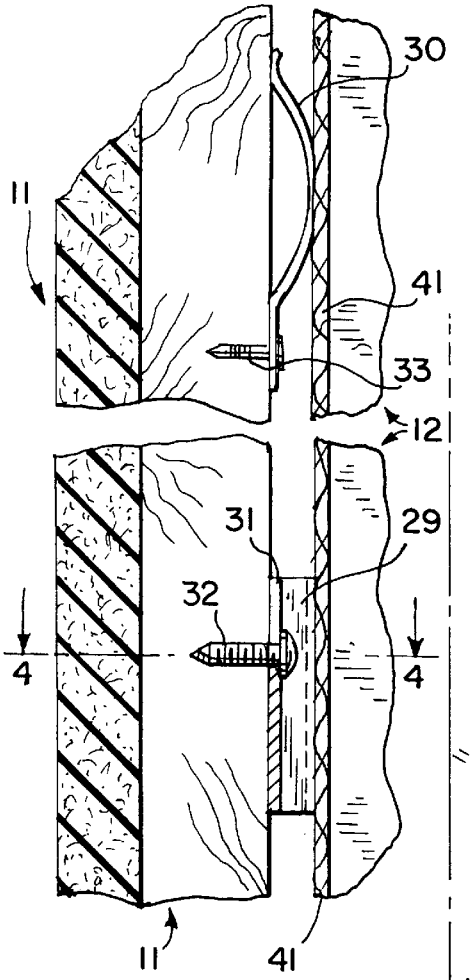
FIG. 3
FIG. 1
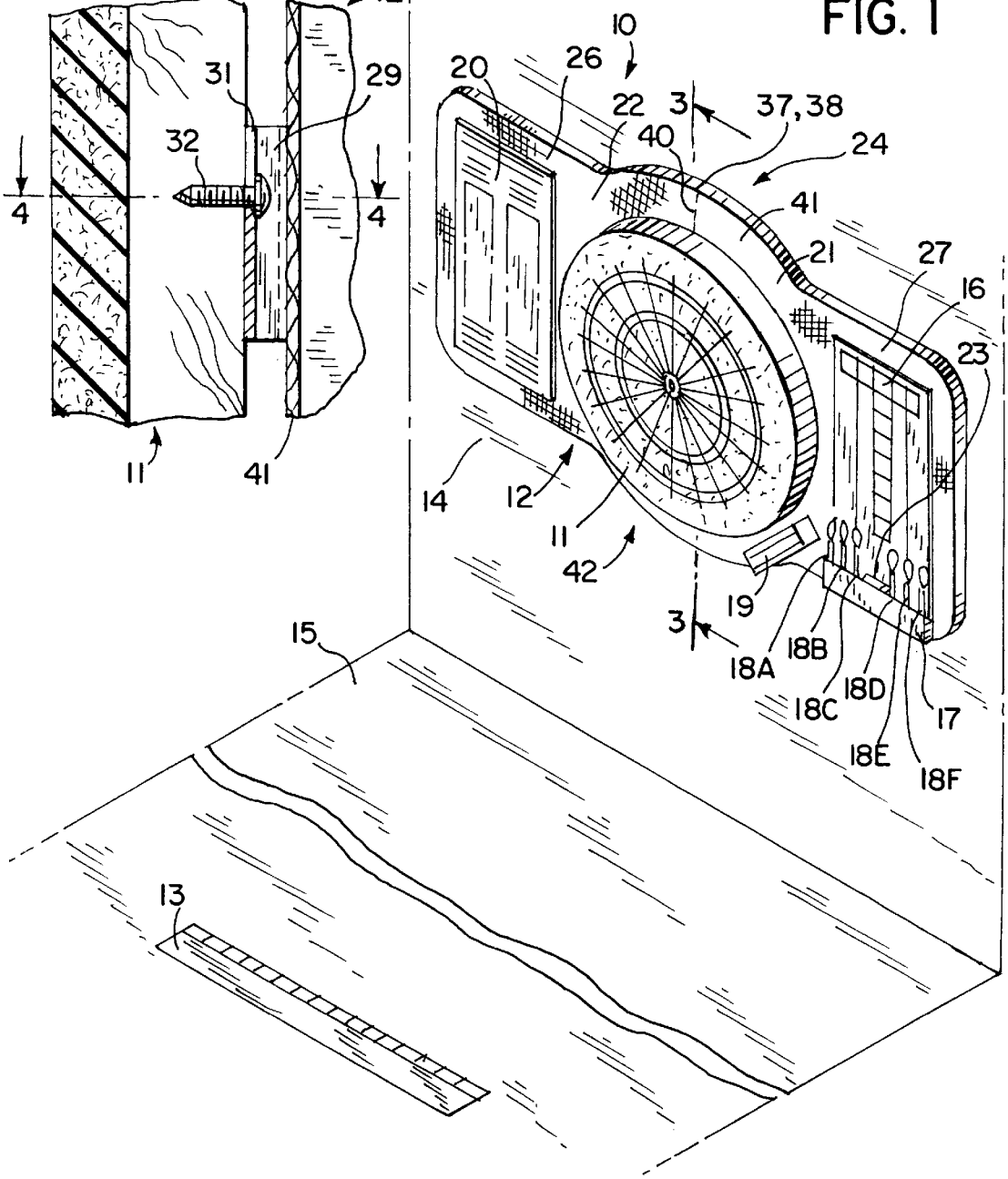

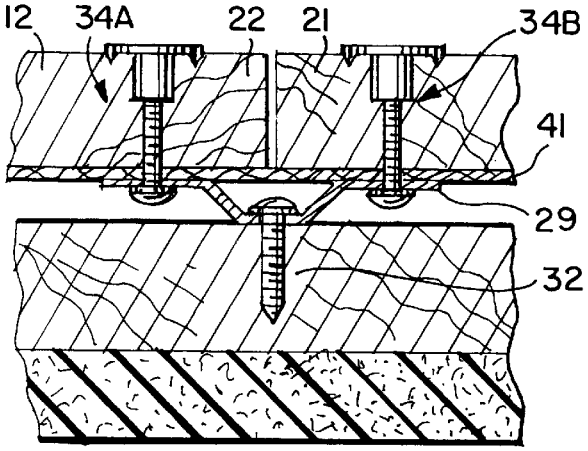
FIG. 4
FIG. 2
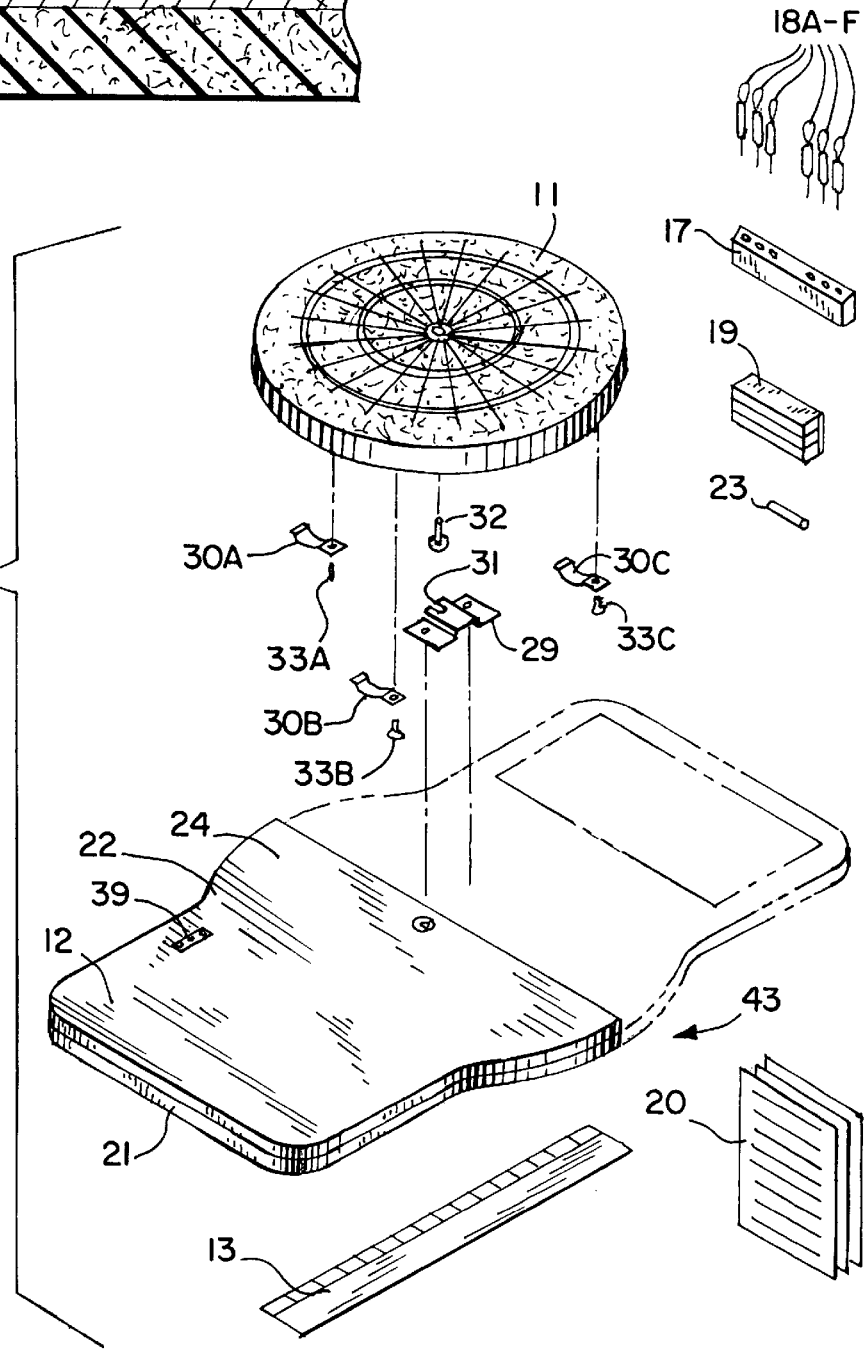

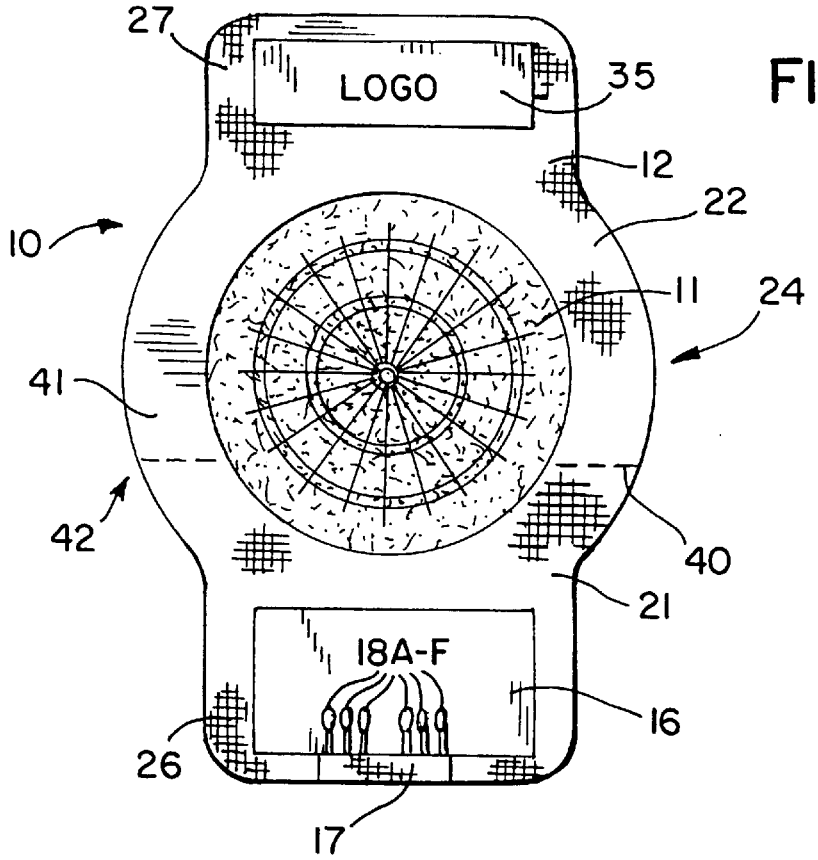
FIG. 5
FIG. 6
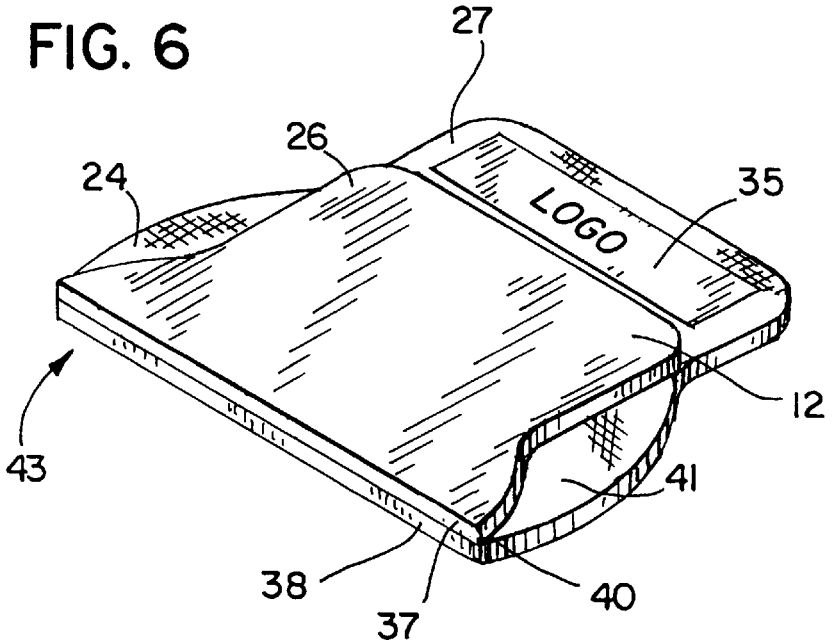

FOLDING BACKBOARD FOR RECEIVING A DART BOARD THEREON

BACKGROUND OF THE INVENTION

This invention relates generally to a dart board backboard, and more particularly, to a folding backboard that folds and unfolds between an open position in which a dart board is readily mounted to the backboard, and a closed position for storage and/or transportation of the backboard when the dart board is removed from the backboard.

Conventional dart board backboards are cumbersome to use because of their size. The width and height of a conventional backboard is usually larger than the diameter of a dart board making it burdensome to handle. In addition, mounting a conventional backboard to a wall, or some other fixed surface that requires protection from poorly thrown darts, can be cumbersome.

Another problem with conventional backboards is that they are relatively expensive. Conventional backboards are usually manufactured as part of a cabinet which has an extensive number of parts and requires a great deal of assembly. Conventional cabinets are quite large and have a width, height and thickness larger than a conventional dart board. The overall size of conventional dart cabinets, which often include a dart board, make them unwieldy such that it is difficult to store the cabinet or move it to another location. The size and design of conventional dart cabinets makes it cumbersome to mount them to a wall or some other fixed surface.

Conventional dart cabinets also secure a variety of dart-related accessories inside, including darts, a chalkboard, a rule-chart, chalk and/or an eraser. Adding assorted accessories to conventional game cabinets makes them even larger, more expensive, harder to assemble and more difficult to mount.

One attempt at providing such a dart cabinet is disclosed in U.S. Pat. No. 3,501,149. This patent discloses a dart cabinet comprising a circular dart board which is mounted so that it can be rotated from time to time to provide a fresh dart receiving surface on a dart board. This particular dart cabinet also comprises doors, sides, a top, a bottom, legs, and a backboard making it extremely bulky, expensive, and difficult to assemble. The size and weight of the cabinet also makes it quite difficult to mount on a wall or some other fixed surface.

Another dart cabinet, disclosed in U.S. Pat. No. 4,625,974, shows a target and a one-piece backboard mounted behind the target enclosed within a cabinet. The target is exposed by opening a pair of cabinet doors which are mounted to the sidewalls of the cabinet such that when the cabinet doors are swung open the interior portion of each door functions as an extension to the backboard. As with U.S. Pat. No. 3,501,149, the size and weight of this particular cabinet makes it extremely bulky, expensive, difficult to assemble, and very cumbersome to mount to a wall, or some other fixed surface.

A typical dart board backboard is shown in U.S. Pat. No. D328,726 which shows a dart board and catcher with the catcher being larger in width and height than the diameter of the dart board.

Further examples of prior art include U.S. Pat. Nos. D387,388 and 4,151,996. However, none of these references provide a folding dart board backboard capable of receiving a dart board thereon, that is inexpensive to manufacture, requires little or no assembly, and is easily mounted to a wall or some other fixed surface. In addition, none are capable of being reduced to a smaller size for easy storage and transportation while still allowing for quick and simple mounting of a dart board to a backboard. All of these features are strongly desired in an inexpensive dart board backboard by dart enthusiasts.

SUMMARY OF THE INVENTION

The present invention overcomes the aforementioned problems by providing a folding backboard capable of attachment to a fixed surface and of receiving a dart board thereon. The folding backboard is adapted to have a dart board mounted to it so that the backboard prevents a wall, or some other fixed surface on which the backboard is mounted, from being damaged by poorly thrown darts. The folding backboard is also at least partially made of a material which is capable of receiving and securing poorly thrown darts so that the dart tips are also protected from damage. The present invention also provides a dart center which utilizes the folding backboard to overcome the aforementioned problems associated with conventional dart cabinets.

The folding backboard of the present invention includes first and second sections which are foldably attached. The first and second sections of the backboard are unfolded into an open position such that a dart board is readily mounted over both the first and second sections. In the open position the backboard is also easily mounted to a wall which needs protection from poorly thrown darts. When the dart board is removed from the backboard, the first and second sections can be folded together into a closed position to reduce the width and height of the backboard by as much as one-half in order to facilitate transportation and/or storage of the backboard.

The present invention also provides a dart center which includes a folding backboard, a dart board and a throw-line marker which is placed on the floor to designate the minimum throwing distance during a game of darts. The dart center may further include various dart-related accessories, such as extra darts and dart accessories, a rule book, score-sheets, chalk, a chalkboard, writing utensils and an eraser. In addition, the dart center may include some type of mounting apparatus, e.g., a bracket and pin combination, or the like, which can be used for mounting the dart board to the folding backboard. Additional mounting hardware is included in the dart center to mount the backboard to a wall, or some other fixed surface.

One object of the present invention is to provide a backboard for a dart board that can be folded and unfolded between an open position where a dart board can be readily mounted to each section of the backboard, and a closed position where the size of the backboard is substantially reduced for easier handling.

An additional object of the present invention is to provide a folding backboard for a dart board that is easy to manufacture, easy to assemble, and inexpensive.

Another object of the present invention is to provide a folding backboard that allows a dart board to be readily mounted thereon.

Still another object of the present invention is to provide a folding backboard for a dart board that is easily mounted to a wall, or some other fixed surface.

Yet another object of the present invention is to provide a dart center that includes a dart board, a folding backboard, a throw-line marker and assorted dart accessories which allows for quick and easy assembly of the dart board to the folding backboard and simple mounting of the backboard to a wall, or some other fixed surface that needs protection from poorly thrown darts.

Various other features, objects and advantages of the present invention will be made apparent from the following detailed description and the drawings.

BRIEF DESCRIPTION OF THE DRAWINGS

The drawings illustrate the best mode presently contemplated for carrying out the invention.

In the drawings:

FIG. 1 is a perspective view of a dart center according to the present invention with a backboard unfolded into an open position and a dart board and assorted dart-related accessories mounted to the backboard.

FIG. 2 is an exploded perspective view of the dart center of FIG. 1 with the dart board removed and the backboard folded into a closed position.

FIG. 3 is a sectional view taken along line 3—3 of FIG. 1.

FIG. 4 is a sectional view taken along line 4—4 of FIG. 3.

FIG. 5 is a front view of another embodiment of a folding backboard and a dart center according to the present invention with the backboard unfolded into an open position and a dart board and various dart related accessories mounted to the backboard.

FIG. 6 is a perspective view of the backboard used in the dart center of FIG. 5 with the backboard folded into a closed position.

DETAILED DESCRIPTION OF THE PREFERRED EMBODIMENT

Referring now particularly to FIG. 1, a dart center 10 includes a dart board 11, a backboard 12 and a throw-line marker 13. Dart board 11 is mounted to backboard 12, and backboard 12 is mounted to a fixed surface, such as a wall 14. Throw-line marker 13 is placed on floor 15 at a desired distance from the face of dart board 11 in order to designate a location from which darts should be thrown during a dart game.

Backboard 12 includes a first section 21 and a second section 22. First section 21 and second section 22 are foldably attached via a hinge 40. Hinge 40 is preferably a living hinge and can be made of a cloth material capable of receiving VELCRO attachments thereon. Alternatively, metal hinges may be fastened to both first section 21 and second section 22 beneath the cloth material to form hinge 40. When first section 21 and second section 22 are unfolded, as shown in FIG. 1, dart board 11 is readily mounted to both first section 21 and second section 22 in a dart board mounting area 24. First section 21 and second section 22 are at least partially made of a dart reception material 41 that can receive and secure a poorly thrown dart which misses the dart board such that backboard 12 provides protection to wall 14 without damage to the darts. Dart reception material 41 is preferably a composite material, such as cork, which is similar to particle board.

Dart center 10 may also include assorted dart-related accessories such as a chalkboard 16 for scoring dart games, a dart rack 17 for securing darts 18A–F, an eraser 19, a rule-chart 20 and chalk 23. The dart accessories are removably attached to backboard 12 with strips of VELCRO.

Although various shapes are contemplated and within the scope of the appending claims, first section 21 and second section 22 are preferably shaped such that dart board mounting area 24, which is formed when first section 21 and second section 22 are foldably attached and in an open position 42, and is circular in shape and larger than the size of dart board 11. Further, first section 21 and second section 22 are shaped such that lateral projections 26, 27 extend outwardly from the circular shape of dart mounting area 24 and are sized such that one or more dart accessories, e.g., chalkboard 16, dart rack 17 and/or rule-chart 20, can be mounted on lateral projection 26 and/or lateral projection 27. First section 21 and second section 22 extend outwardly from folding edges 37, 38 and are sized to be able to receive dart board 11 and one or more of the aforementioned dart-related accessories.

FIG. 2 shows dart center 10 with dart board 11 removed from backboard 12 and first section 21 and second section 22 folded against one another into a closed position 43. Dart center 10 may further include mounting apparatus for installing dart board 11 onto backboard 12, and mounting apparatus for installing backboard 12 onto wall 14, or some other fixed surface. The mounting apparatus for installing dart board 11 onto backboard 12 preferably includes bracket 29, which is mounted to first section 21 and second section 22 in dart board mounting area 24, as well as pin 32 and spacers 30A, 30B and 30C, which ensure that dart board 11 remains substantially parallel to backboard 12. The mounting apparatus for installing backboard 12 on wall 13 preferably includes at least a pair of hanging bracket 39 which are mounted on some a pin or stud embedded in wall 14.

Referring now to FIG. 3, bracket 29 is shown securing dart board 11 to backboard 12. Bracket 29 has slot 31 into which pin 32 can slide such that dart board 11 hangs from bracket 29 via pin 32. Spacer 30 is also shown mounted to dart board 11 via fastener 33. One or more spacers can be utilized to ensure that dart board 11 remains substantially parallel to backboard 12 when dart board 11 is mounted to backboard 12. As best shown in FIG. 4, bracket 29 is preferably connected to first section 21 and second section 22 of backboard 12 by using fasteners 34A, 34B.

FIG. 5 shows dart center 10 with another embodiment of backboard 12. When folded in the closed position 43 backboard 12 will be the most compact when first section 21 and second section 22 are the same size (see FIG. 2). However, first section 21 and second section 22 may be different sizes as illustrated in FIG. 5. Even though first section 21 and second section 22 are different sizes in this embodiment, dart board 11 is still mounted over both first section 21 and second section 22 in dart board mounting area 24. This embodiment may further include vertical projections 26, 27 which extend from dart board mounting area 24 and are capable of receiving one or more dart-related accessories. Of particular interest in this embodiment, is the position of a logo 35. As best shown in FIG. 6, when dart board 11 is removed from backboard 12, and first section 21 and second section 22 are folded into closed position 43, logo 35 remains visible for observation. This feature is particularly important for display in retail stores. The logo may include a sponsoring or third party advertisement.

It is further contemplated that backboard 12 could be constructed of more than two sections such that when dart board 11 is mounted to backboard 12, dart board 11 is attached to each section of backboard 12. The sections of backboard 12 can be folded onto one another such that backboard 12 is placed into a closed or semi-closed position where the width and height of backboard 12 is reduced each time one section of backboard 12 is folded onto another section to minimize storage size.

In all of the aforementioned embodiments of this invention, and others not specifically mentioned, first section 21 and/or second section 22 may have a handle formed therein in order to facilitate handling backboard 12 in either the open or closed position.

From the foregoing it will be to those skilled in the art that a variety of changes and modifications, outside from those expressly stated, can be made without departing from the spirit of this invention and the scope of the claims.

What is claimed is:

1. A folding backboard for receiving a dart board thereon comprising:

a first section at least partially constructed of dart reception material and capable of receiving and securing a dart therein; and a second section at least partially constructed of dart reception material and capable of receiving and securing a dart therein, the second section is foldably attached to the first section, wherein the first section and second section unfold into an open position such that a dart board is mountable over the first section and the second section of the folding backboard, and fold into a closed position such that the first section and the second section at least partially overlap when the dart board is removed from the backboard.

2. The folding backboard of claim 1 wherein the first section is substantially identical in shape to the second section to minimize an overall size of the folding backboard when in the closed position.

3. The folding backboard of claim 1 wherein the first section is smaller than the second section such that a portion of the second section having a visual display thereon is exposed from the first section when the folding backboard is folded into the closed position.

4. A folding backboard for receiving a dart board thereon comprising:

a first section at least partially constructed of dart reception material and capable of receiving and securing a dart therein;

a second section at least partially constructed of dart reception material and capable of receiving and securing a dart therein; and a hinge foldably connecting the first section to the second section, wherein the first section and second section unfold into an open position in which the folding backboard is mountable to a fixed surface and a dart board is mountable to the folding backboard over the hinge in a dart board mounting area, and fold in the dart board mounting area into a closed position for storing the folding backboard when the dart board is removed.

5. The folding backboard of claim 4 wherein the first section and the second section are at least partially made of cork.

6. The folding backboard of claim 4 wherein a handle is formed within one of the first section and the second section.

7. The folding backboard of claim 4 wherein the first section and the second section are shaped such that the dart board mounting area is a circular shape larger than the size of the dart board.

8. The folding backboard of claim 7 wherein at least one of the first section and the second section extends outwardly from the circular shape, having a width to receive a dart game accessory thereon.

9. The folding backboard of claim 8 wherein the dart game accessory is a chalkboard for scoring a game of darts.

10. The folding backboard of claim 9 wherein the chalkboard has a height substantially equal to a diameter of the dart board.

11. The folding backboard of claim 8 wherein the dart game accessory is a rule-chart having rules of various dart games thereon.

12. The folding backboard of claim 4 wherein the first section and the second section extend outwardly from a folding edge, having a width to receive a dart game accessory thereon.

13. The folding backboard of claim 12 wherein the first section and the second section are at least as wide as the dart board and extend outwardly from the folding edge.

14. A folding backboard for receiving a dart board thereon comprising:

a first section at least partially constructed of dart reception material and capable of receiving and securing a dart therein;

a second section at least partially constructed of dart reception material and capable of receiving and securing a dart therein; and a hinge foldably connecting the first section to the second section, wherein the first section and second section unfold into an open position in which the folding backboard is mountable to a fixed surface and a dart board is mountable to the folding backboard over the hinge in a dart board mounting area, and fold in the dart board mounting area into a closed position for storing the folding backboard when the dart board is removed; and wherein the dart board is mountable to the folding backboard with a mounting apparatus comprising a first bracket having a slot therein attached to the folding backboard, and a pin attached to the dart board receivable into the slot of the first bracket for mounting the dart board to the folding backboard.

15. The folding backboard of claim 14 wherein the mounting apparatus further comprises a plurality of spacer brackets mounted to the dart board to arrange the dart board substantially parallel with the folding backboard.

16. A dart center comprising:

a dart board;

a folding backboard having a first section and a second section foldably attached to the first section, wherein the first section and second section unfold into an open position such that the dart board is mountable over both the first section and second section of the folding backboard, and fold into a closed position such that the first section at least partially overlaps the second section when the dart board is removed from the backboard; and a throw line marker for designating a dart throwing location.

17. The dart center of claim 16 further comprising at least one dart accessory including darts, a rule-chart, score-sheets, chalk, a chalkboard, writing utensils, and an eraser which is capable of being attached to the folding backboard.

18. The dart center of claim 16 further comprising a mounting apparatus for mounting the dart board to the folding backboard.

19. The dart center of claim 16 wherein a length of the first section and a length of the second section are not equal, thereby extending a portion of one section past the other section when folded.

20. A dart center comprising:

a dart board;

a folding backboard having a first section and a second section foldably attached to the first section, wherein the first section and second section unfold into an open position such that the dart board is mountable over both the first section and second section of the folding backboard, and fold into a closed position such that the first section at least partially overlaps the second section when the dart board is removed from the backboard; and a throw line marker for designating a dart throwing location;

a mounting apparatus for mounting the dart board to the folding backboard wherein the mounting apparatus comprises a bracket having a slot therein which is adapted to mount the dart board over the first section and the second section of the folding backboard, and a pin attached to the dart board receivable into the slot of the bracket.

21. The dart center of claim 20 wherein the mounting apparatus further comprises a plurality of spacers mounted to the dart board to arrange the dart board substantially parallel with the folding backboard.

22. A dart center comprising:

a dart board;

a folding backboard having a first section and a second section foldably attached to the first section, wherein the first section and second section unfold into an open position such that the dart board is mountable over both the first section and second section of the folding backboard, and fold into a closed position such that the first section at least partially overlaps the second section when the dart board is removed from the backboard, and wherein a handle is formed within one of the first section and the second section; and a throw line marker for designating a dart throwing location.

* * * * *